US010113337B2

(12) United States Patent
Wu

(10) Patent No.: US 10,113,337 B2
(45) Date of Patent: Oct. 30, 2018

(54) LOCKSET

(71) Applicant: SINOX CO., LTD, New Taipei (TW)

(72) Inventor: Chun-Sheng Wu, New Taipei (TW)

(73) Assignee: SINOX CO., LTD, New Taipei (TW)

( * ) Notice: Subject to any disclaimer, the term of this patent is extended or adjusted under 35 U.S.C. 154(b) by 0 days.

(21) Appl. No.: 15/354,068

(22) Filed: Nov. 17, 2016

(65) Prior Publication Data

US 2017/0138093 A1 May 18, 2017

(30) Foreign Application Priority Data

Nov. 17, 2015 (TW) ..... 104218434 U

(51) Int. Cl.
*E05B 65/52* (2006.01)
*E05B 65/48* (2006.01)

(52) U.S. Cl.
CPC ..... *E05B 65/5276* (2013.01); *E05B 65/48* (2013.01); *E05B 65/52* (2013.01); *E05B 65/5269* (2013.01); *E05B 65/5284* (2013.01)

(58) Field of Classification Search
CPC ..... E05B 65/48; E05B 65/50; E05B 65/52; E05B 65/5207; E05B 65/5246; E05B 65/5253; E05B 65/5261; E05B 65/5269; E05B 65/5276; E05B 65/5284
See application file for complete search history.

(56) References Cited

U.S. PATENT DOCUMENTS 4,068,873 A * 1/1978 Testa ..... E05B 65/52 292/101
4,074,549 A * 2/1978 Yee ..... E05B 65/52 292/247
4,155,234 A * 5/1979 Bako ..... E05B 37/12 70/312
4,761,974 A * 8/1988 Lii ..... E05B 37/02 70/312
4,920,771 A * 5/1990 Jiang ..... E05B 37/02 70/312
5,438,853 A * 8/1995 Bartsch ..... E05B 15/0006 292/242
5,485,734 A * 1/1996 Yang ..... E05B 37/0034 70/285
5,692,403 A * 12/1997 Ling ..... E05B 37/02 70/312
5,713,226 A * 2/1998 Yu ..... E05B 65/52 70/312
6,173,592 B1 * 1/2001 Yu ..... E05B 37/12 70/312

* cited by examiner

*Primary Examiner* — Christopher J Boswell
(74) *Attorney, Agent, or Firm* — Innovation Capital Law Group, LLP; Vic Lin

(57) ABSTRACT

The lockset includes a first body and a second body. The first body includes a lock body disposed in the first body, a first upper face having a lock hole and a first side face having a positioning hole. The second body includes a second upper face and a second side face. A rotatable buckle having a rotating unit and a lock unit is disposed on the second upper face. One end of the rotating unit is pivotally connected with the second upper face and the other end is connected with the lock unit. A positioning unit is disposed on the second side face. When the first side face is in a lock position, the positioning unit inserts into the positioning hole, and the rotatable unit may be rotated to insert the lock unit into the lock hole, wherein the lock body restricts the lock unit from leaving the lock hole.

16 Claims, 8 Drawing Sheets

LOCKSET

BACKGROUND OF THE INVENTION

1. Field of the Invention

The present invention generally relates to a lockset for use with a case.

2. Description of the Prior Art

FIG. 1 shows that users usually load items in a case 20 with a lockset 90 to secure their luggage while traveling. Wherein, the case 20 could be but not limited to a luggage case, a suitcase or a briefcase. Conventionally, the lockset 90 includes a combination lock or a key lock, and users can unlock the lockset 90 to open the case 20 by rotating at least one number dial to the right combination or using a matching key. Wherein, the combination lock includes an unlock button 91 to be pressed to unlock the lockset 90 after rotating the number dials to the right combination.

Furthermore, the lockset 90 could be used with a zipper 40 of the case 20. To secure the zipper 40 with the lockset 90, sliders 41 of the locked zipper 40 can be inserted or embedded into grooves 92 of the lockset 90, and a movable pin or a latch comes through the holes of the sliders 41. To open the case 20, the movable pin or the latch can be released from the holes of the sliders 41 by unlocking the lockset 90, and the sliders 41 separated from the grooves 92 of the lockset 90 can be moved to unlock the zipper 40.

However, the lockset 90 protruding from the surface of the case 20 could be broken by impact or other causes while travelling. Furthermore, when the lockset 90 is used with the zipper 40 of the case 20, the locking function might become invalid because of damaged sliders 41.

SUMMARY OF THE INVENTION

The present invention generally relates to a lockset.

The lockset of the present invention includes a first body and a second body. The first body includes a lock body, a first upper face and a first side face. The lock body is disposed in the first body. The first upper face has a lock hole. The first side face has a positioning hole. There is a first angle between the first upper face and the first side face. The second body includes a second upper face and a second side face. The first upper face and the second upper face both face the same direction. A rotatable buckle having a rotating unit and a lock unit is disposed on the second upper face. One end of the rotating unit is pivotally connected with the second upper face and the side of the other end of the rotating unit facing the second upper face is connected with the lock unit. The second side face faces the first side face. A positioning unit is disposed in a position on the second side face corresponding to the positioning hole. There is a second angle between the second upper face and the second side face. When the first side face is in a lock position adjacent to the second side face, the positioning unit inserts into the positioning hole, and the rotatable unit is rotated to insert the lock unit into the lock hole, wherein the lock body restricts the lock unit from leaving the lock hole.

In one embodiment, the lockset of the present invention includes a first body and a second body. The first body includes a first upper face and a first side face. The first upper face has a lock hole. The first side face has a positioning hole. There is a first angle between the first upper face and the first side face. The second body includes a lock body, a second upper face and a second side face. The lock body is disposed in the second body. The first upper face and the second upper face both face the same direction. A rotatable buckle having a rotating unit and a lock unit is disposed on the second upper face. One end of the rotating unit is pivotally connected with the second upper face and the side of the other end of the rotating unit facing the second upper face is connected with the lock unit. The second side face faces the first side face. A positioning unit is disposed in a position on the second side face corresponding to the positioning hole. There is a second angle between the second upper face and the second side face. When the first side face is in a lock position adjacent to the second side face, the positioning unit inserts into the positioning hole, and the rotatable unit is rotated to insert the lock unit into the lock hole, wherein the lock body restricts the rotating unit from rotating and hence restricts the lock unit from leaving the lock hole.

The lock unit includes an annulation. A guiding portion is disposed in a position of the annulation near the end of the rotating unit pivotally connected with the second upper face. The lock unit includes a hook.

There are respectively at least one pair of the lock unit and the corresponding lock hole. There are at least two lock holes disposed in different positions on the first upper face having different distances with respect to the first side face. The first angle is 90°. The second angle is 90°. The lock body includes a combination lock.

The lockset of the present invention prevents damage caused by an impact on the sliders and makes the locking more solid.

The above description and the following embodiments are merely illustrative and make no limitation to the scope of the invention as defined by the appended claims.

DETAILED DESCRIPTION OF THE INVENTION

Figure 1:
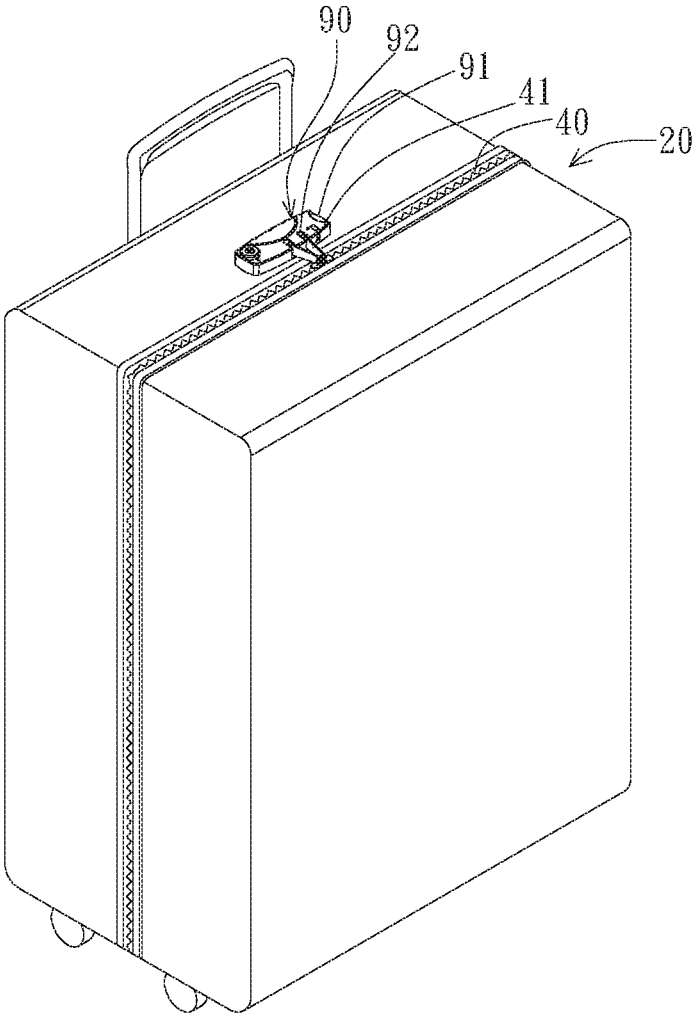
FIG. 1 (PRIOR ART)
FIG. 1 is a perspective view of a prior art.
Figure 2:
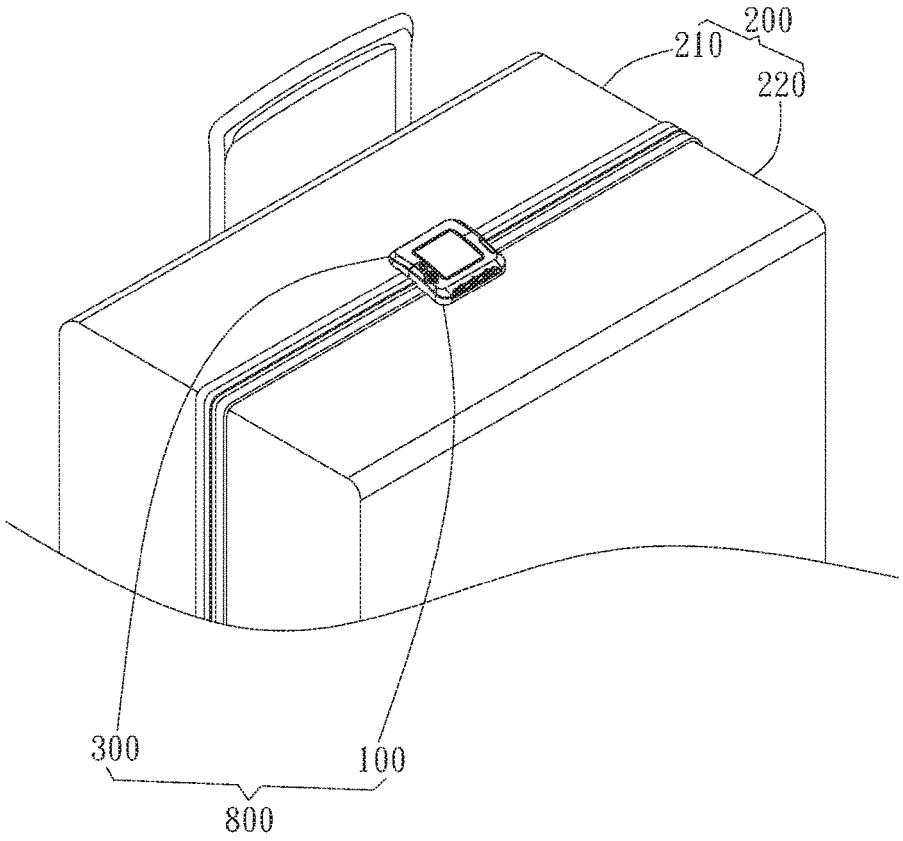
FIG. 2 is a perspective view of an embodiment of the invention used with a case.

As the embodiment shown in FIG. 2, the lockset 800 of the present invention is in use with a case 200. In this embodiment, the case 200 is a luggage case having a first body 210 and a second body 220. The first body 210 and the second body 220 are connected by an axle side, and the case 200 can be opened from the other side of the first body 210 and the second body 220. In other embodiments, the case could be a suitcase or a briefcase and is not limited to a case which is composed of two bodies connected by a side.

Figure 3:
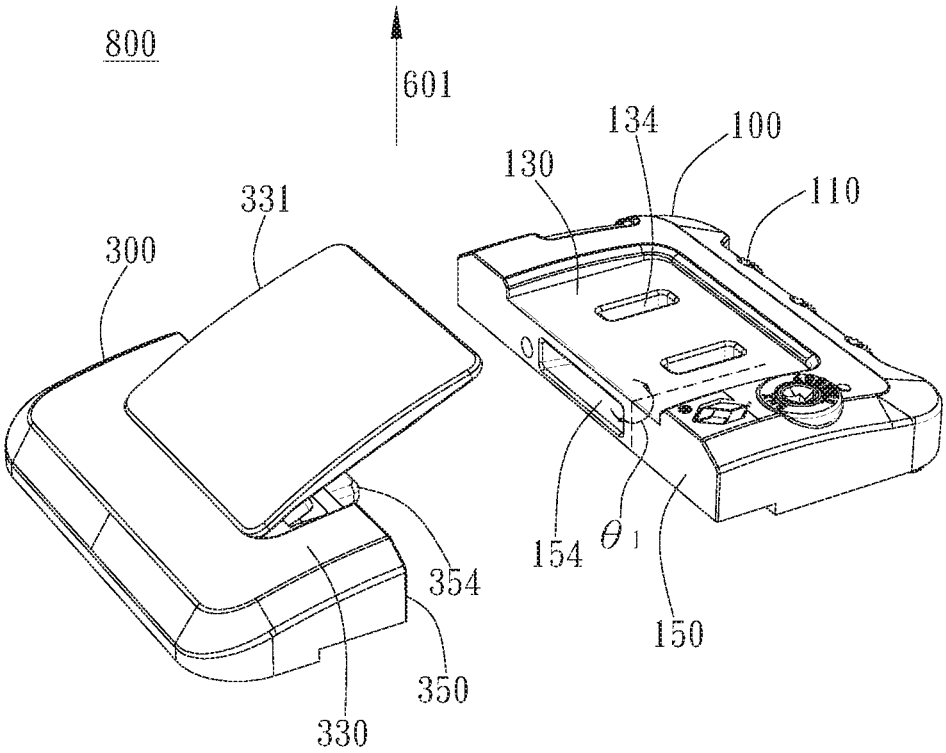
FIGS. 3, 4A and FIG. 4B are perspective views of embodiments of the invention.
Figure 4A:
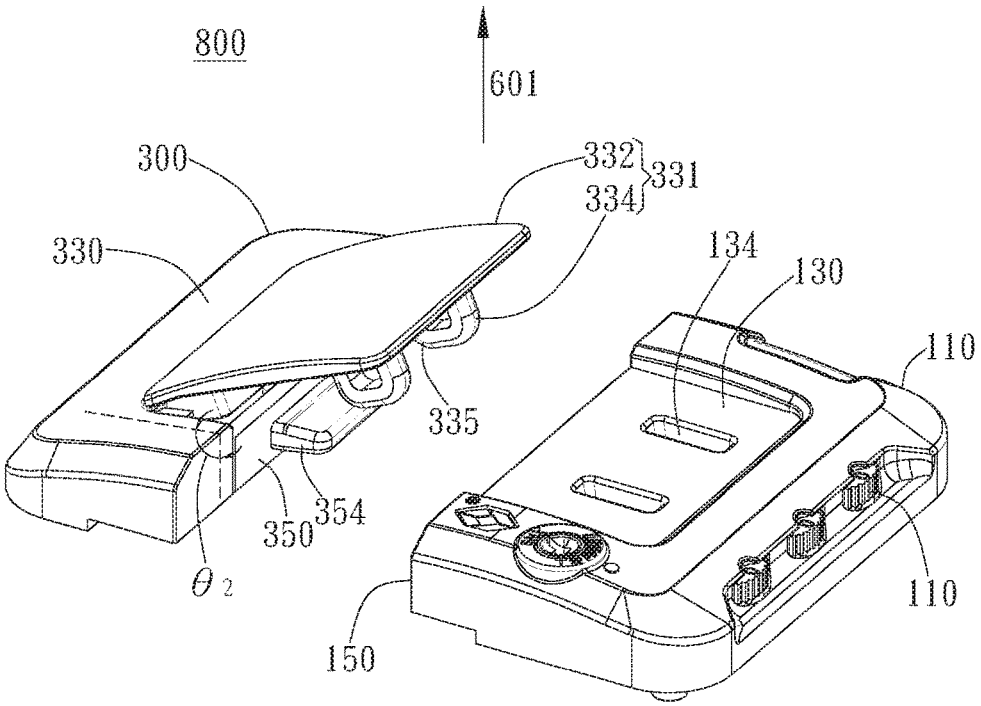

As the embodiments shown in FIGS. 3 and 4A, the lockset 800 of the present invention includes a first body 100 and a second body 300. The first body includes a lock body 110, a first upper face 130 and a first side face 150. The lock body 110 is disposed in the first body 100. The first upper face 130 has a lock hole 134. The first side face 150 has a positioning hole 154. There is a first angle $\theta_1$ between the first upper face 130 and the first side face 150. The first angle $\theta_1$ is preferably 90°. In the embodiments shown in FIGS. 3 and 4A, the lock body is a combination lock with its dials at least partially exposed by the first body 100. In different embodiments, the lock body could be a key lock or other types of lock.

As the embodiments shown in FIGS. 3 and 4A, the second body 300 includes a second upper face 330 and a second side face 350. The first upper face 130 and the second upper face 330 both face the direction 601. A rotatable buckle 331 including a rotating unit 332 and a lock unit 334 is disposed on the second upper face 330. One end of the rotating unit 332 is pivotally connected with the second upper face 330 and the side of the other end of the rotating unit 332 facing the second upper face 330 is connected with the lock unit 334. The second side face 350 faces the first side face 150. A positioning unit 354 is disposed in a position on the second side face 350 corresponding to the positioning hole 154. There is a second angle $\theta_2$ between the second upper face 330 and the second side face 350. The second angle $\theta_2$ is preferably 90°.

Figure 6A:
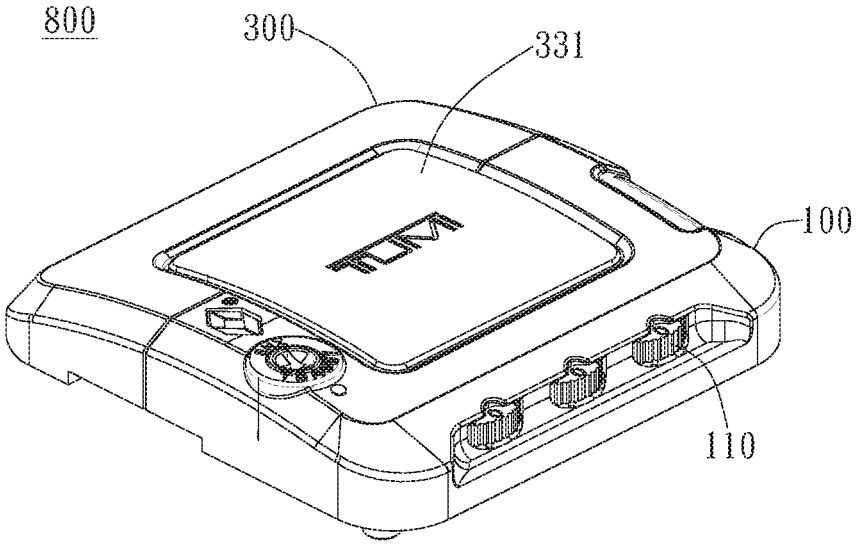
FIGS. 6A and 6B are perspective views to show the rotatable unit rotating to make the lock unit insert into the lock hole according to an embodiment of the invention.
Figure 6B:
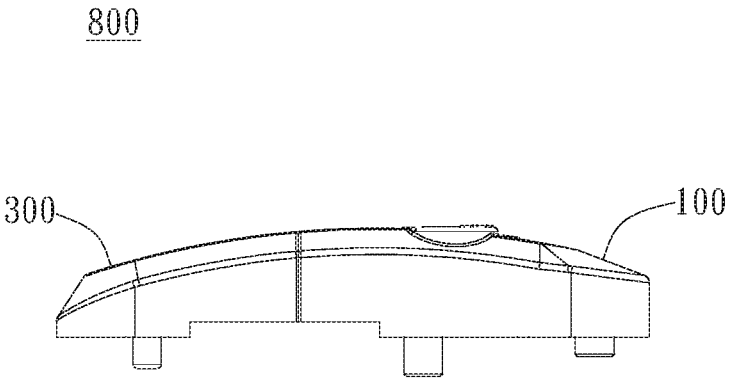

The operation of the lock is described further as following. As the embodiments shown in FIGS. 3, 4A, and 4B, when the rotatable buckle 331 is tilted toward direction 601, the lock unit 334 doesn't collide with the first body 100, the first body 100 and the second body 300 are free to move with respect to each other. To achieve a lock-state of the lockset 800, the first body 100 and the second body 300 are placed close to each other, i.e. the first side face 150 is put in a lock position adjacent to the second side face 350, hence allowing the positioning unit 354 on the second side face 350 to be inserted into the corresponding positioning hole 154. Afterward, as shown in FIGS. 6A and 6B, the rotatable unit 332 is then rotated to insert the lock unit 334 (shown in FIG. 4A) into the lock hole (shown in FIG. 4A), wherein the lock body 110 restricts the lock unit 334 from leaving the lock hole 134.

More particularly, when the lockset 800 is in the lock-state, a movable restricting unit (e.g. a pin or a latch) is disposed in the lock hole 134 to restrict the lock unit 334 from leaving the lock hole 134 in order to achieve locking. On the other hand, since the positioning unit 354 on the second side face 350 inserts into the corresponding positioning hole 154 at the same time, the locking between the first body 100 and the second body 300 is more firm.

Figure 4B:
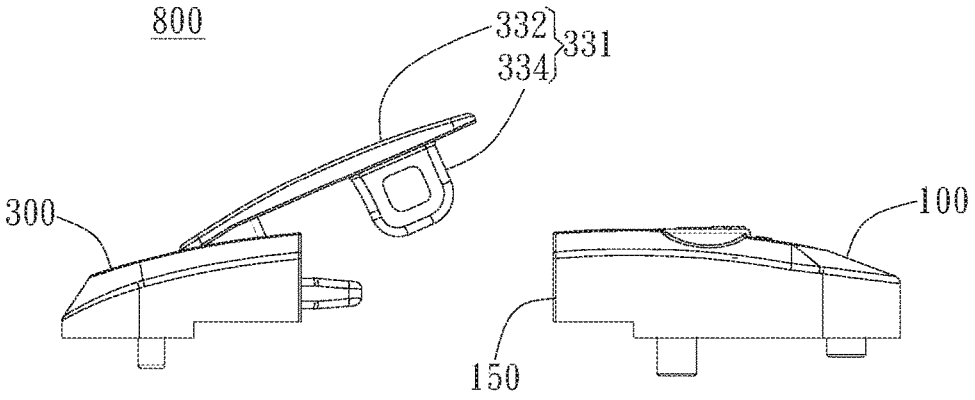
Figure 5A:
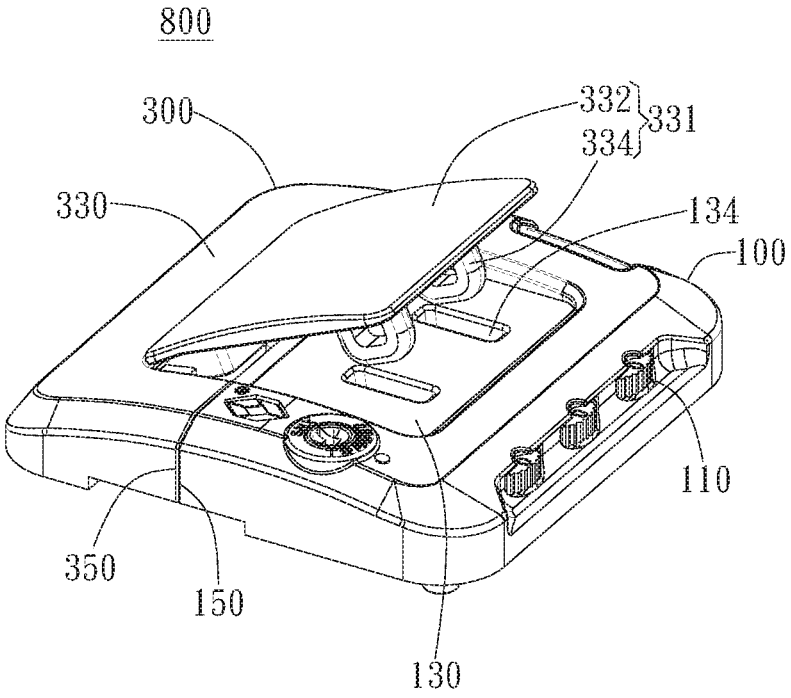
FIGS. 5A and 5B are perspective views to show the positioning unit inserting into the positioning hole according to an embodiment of the invention.
Figure 5B:
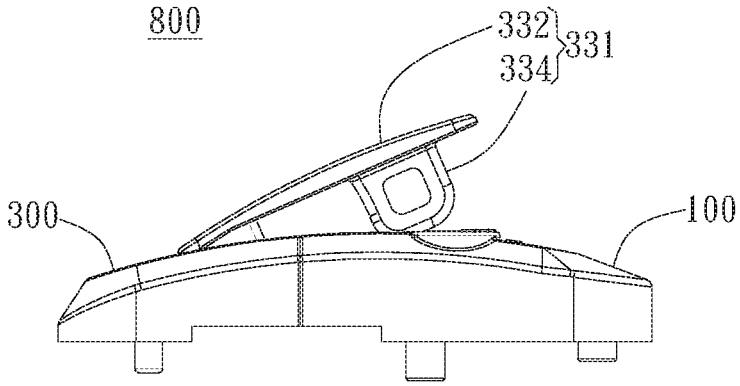
Figure 7A:
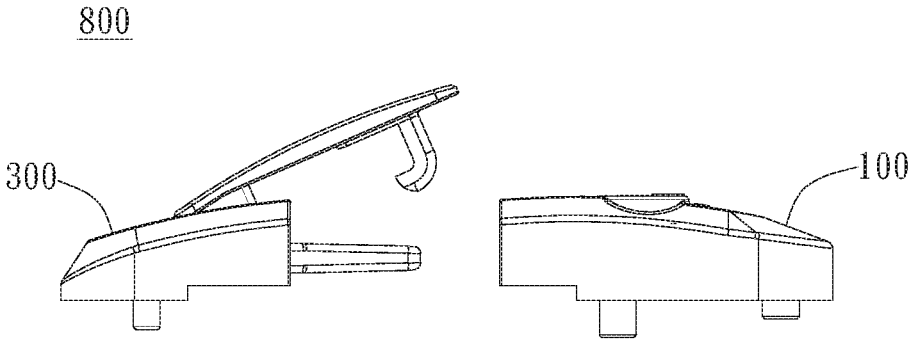
FIG. 7A is a perspective view to show the lock unit is an annulation according to an embodiment of the invention.

As the embodiments shown in FIGS. 4A and 4B, the lock unit 334 includes an annulation. A guiding portion 335 is disposed in a position of the annulation of lock unit 334 near the end of the rotating unit 332 pivotally connected with the second upper face 330 for making the lock unit 334 pass in and out the lock hole 134 more easily. More particularly, the guiding portion 335 is substantially an arc lead angle or an oblique lead angle. Since the lock unit 334 moves along with the rotation of the rotating unit 332, the motion track of the lock unit 334 is an arc. Therefore, when the lock unit 334 passes in and out the lock hole 134, it is oblique, instead of perpendicular, to the pivot direction of the lock hole 134. Accordingly, being substantially an arc lead angle or an oblique lead angle, the guiding portion 335 not only makes the lock unit 334 pass in and out the lock hole 134 more easily, but also generates a divided force to make the first body 100 and the second body 200 closer to each other when the rotating unit 332 is pressed. In the above-described embodiments, the lock unit 334 is an annulation. In different embodiments, the lock unit 334 may be different under different manufacturing or usage requirements. As shown in the embodiment in FIG. 7A, the lock unit 334 is made as a hook to reduce its size.

Figure 7B:
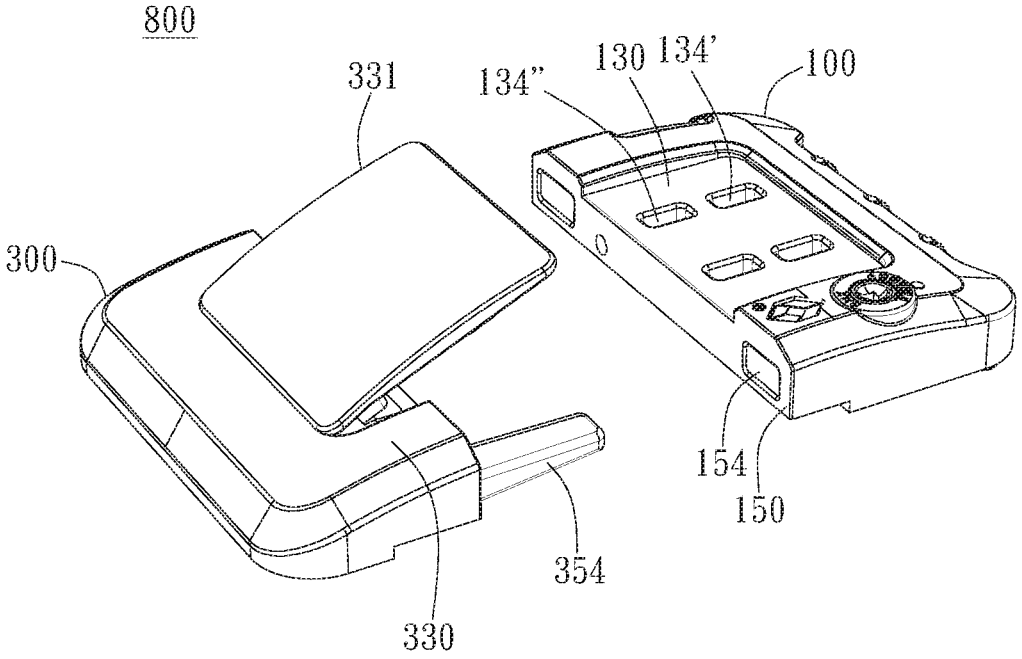
FIG. 7B is a perspective view to show two lock holes disposed in different positions on the first upper face having different distances with respect to the first side face according to an embodiment of the invention.
Figure 8:
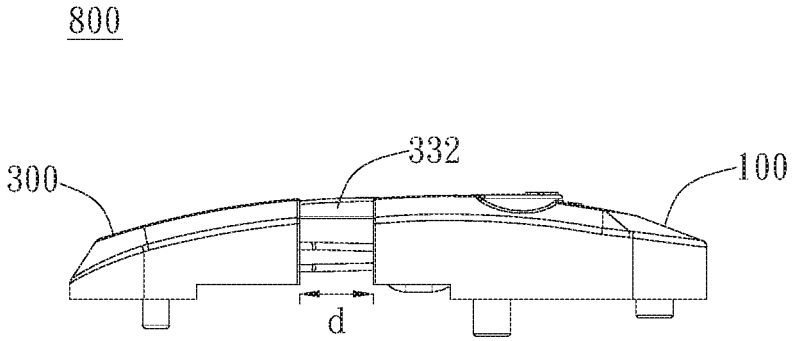
FIG. 8 is a perspective view to show there is a gap between the first body and the second body according to an embodiment of the invention.

Only one lock hole and one corresponding lock unit are needed to achieve their function. However, in the preferable embodiment, there are respectively at least one pair of the lock unit and the corresponding lock hole to make the locking between the first body 100 and the second body 300 more firm. As shown in the embodiment in FIG. 3, the lock holes 134 could be a pair disposed in positions having same distances with respect to the first side face 150. As shown in a different embodiment in FIG. 7B, the lock holes 134' and 134" are disposed in different positions on the first upper face 130 having different distances with respect to the first side face 150. When the lock unit 334 inserts into the lock hole 134" which is closer to the first side face 150, as shown in FIG. 8, there could be a gap between the first body 100 and the second body 300. Because many luggage cases are able to extend their thickness, with the above-described design, the lockset 800 is more flexible to use with a case by inserting the lock unit 334 into a proper lock hole 134 with respect to the change of the thickness of the case.

Figure 9:
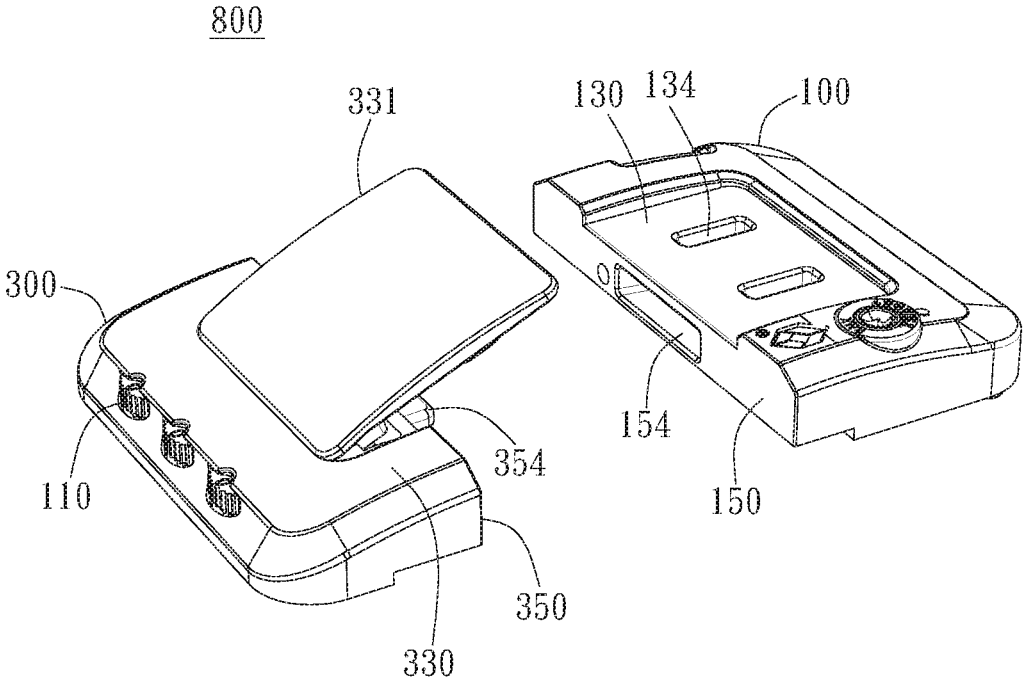
FIG. 9 is a perspective view of a different embodiment of the invention.

As shown in a different embodiment in FIG. 9, the lockset 800 of the present invention includes a first body 100 and a second body 300. The first body 100 includes a first upper face 130 and a first side face 150. The first upper face 130 has a lock hole 134. The first side face 150 has a positioning hole 154. There is a first angle $\theta_1$ between the first upper face 130 and the first side face 150. The second body 300 includes a lock body 110, a second upper face 330 and a second side face 350. The lock body 110 is disposed in the second body 300. The first upper face 330 and the second upper face 130 both face the same direction. A rotatable buckle 331 having a rotating unit 332 and a lock unit 134 is disposed on the second upper face 330. One end of the rotating unit 332 is pivotally connected with the second upper face 330 and the side of the other end of the rotating unit 332 facing the second upper face 330 is connected with the lock unit 334. The second side face 350 faces the first side face 150. A positioning unit 354 is disposed in a position on the second side face 350 corresponding to the positioning hole 154. There is a second angle $\theta_2$ between the second upper face 330 and the second side face 350.

When the first side face 150 is in a lock position adjacent to the second side face 350, the positioning unit 354 inserts into the positioning hole 154, and the rotatable unit 332 is rotated to insert the lock unit 334 into the lock hole 134, wherein the lock body 110 restricts the rotating unit 332 from rotating and hence restricts the lock unit 334 from leaving the lock hole 134. More particularly, the rotatable unit 332 is pivotally connected with the second upper face 330, and the lock body 110 is able to restrict the rotating unit 332 from rotating by interfering the rotation of the pivot of the rotatable unit 332 or the movement of the rotatable unit 332 itself.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A lockset, comprising:

a first body, including:

a lock body disposed in the first body, wherein the lock body includes a combination lock;

a first upper face having a lock hole; and a first side face having a positioning hole, wherein there is a first angle between the first upper face and the first side face; and a second body, including:

a second upper face, wherein the first upper face and the second upper face both face the same direction, wherein a rotatable buckle having a rotating unit and a lock unit is disposed on the second upper face, wherein one end of the rotating unit is pivotally connected with the second upper face and the side of the other end of the rotating unit facing the second upper face is connected with the lock unit; and a second side face facing the first side face, wherein a positioning unit is disposed in a position on the second side face corresponding to the positioning hole, wherein there is a second angle between the second upper face and the second side face;

when the first side face is in a lock position adjacent to the second side face, the positioning unit inserts into the positioning hole, and the rotatable unit is rotated to insert the lock unit into the lock hole, wherein the lock body restricts the lock unit from leaving the lock hole.

2. The lockset of claim 1, wherein the lock unit includes an annulation.

3. The lockset of claim 2, wherein a guiding portion is disposed in a position of the annulation near the end of the rotating unit pivotally connected with the second upper face.

4. The lockset of claim 1, wherein the lock unit includes a hook.

5. The lockset of claim 1, wherein there are respectively at least one pair of the lock unit and the corresponding lock hole.

6. The lockset of claim 1, wherein there are at least two lock holes disposed in different positions on the first upper face having different distances with respect to the first side face.

7. The lockset of claim 1, wherein the first angle is 90°.

8. The lockset of claim 1, wherein the second angle is 90°.

9. A lockset, comprising:

a first body, including:

a first upper face having a lock hole; and a first side face having a positioning hole, wherein there is a first angle between the first upper face and the first side face; and a second body, including:

a lock body disposed in the second body, wherein the lock body includes a combination lock;

a second upper face, wherein the first upper face and the second upper face both face to the same direction, wherein a rotatable buckle including a rotating unit and a lock unit is disposed on the second upper face, wherein one end of the rotating unit is pivotally connected with the second upper face and the side of the other end of the rotating unit facing the second upper face is connected with the lock unit; and a second side face facing the first side face, wherein a positioning unit is disposed in a position on the second side face corresponding to the positioning hole, wherein there is a second angle between the second upper face and the second side face;

when the first side face is in a lock position adjacent to the second side face, the positioning unit inserts into the positioning hole, and the rotatable unit is rotated to insert the lock unit into the lock hole, wherein the lock body restricts the rotating unit from rotating and hence restricts the lock unit from leaving the lock hole.

10. The lockset of claim 9, wherein the lock unit includes an annulation.

11. The lockset of claim 10, wherein a guiding portion is disposed in a position of the annulation near the end of the rotating unit pivotally connected with the second upper face.

12. The lockset of claim 9, wherein the lock unit includes a hook.

13. The lockset of claim 9, wherein there are respectively at least one pair of the lock unit and the corresponding lock hole.

14. The lockset of claim 9, wherein there are at least two lock holes disposed in different positions on the first upper face having different distances with respect to the first side face.

15. The lockset of claim 9, wherein the first angle is 90°.

16. The lockset of claim 9, wherein the second angle is 90°.

* * * * *